US010252551B2

(12) United States Patent
Marco

(10) Patent No.: US 10,252,551 B2
(45) Date of Patent: Apr. 9, 2019

(54) FULL BLEED PRINTING OF RIGID SUBSTRATE

(71) Applicant: Charta Group, Inc, Austin, TX (US)

(72) Inventor: Albert Marco, Austin, TX (US)

(73) Assignee: Charta Group, Inc

( * ) Notice: Subject to any disclaimer, the term of this patent is extended or adjusted under 35 U.S.C. 154(b) by 0 days.

(21) Appl. No.: 15/631,177

(22) Filed: Jun. 23, 2017

(65) Prior Publication Data

US 2018/0370257 A1 Dec. 27, 2018

(51) Int. Cl.

| | |
|---|---|
| ***B65H 9/10*** | (2006.01) |
| ***B41J 11/58*** | (2006.01) |
| ***B41M 5/50*** | (2006.01) |
| ***B65H 9/16*** | (2006.01) |
| ***B41J 13/10*** | (2006.01) |
| ***B65H 9/08*** | (2006.01) |
| ***B41J 11/00*** | (2006.01) |

(52) U.S. Cl.

CPC ..... *B41J 11/58* (2013.01); *B41J 11/00* (2013.01); *B41J 13/10* (2013.01); *B41M 5/50* (2013.01); *B65H 9/08* (2013.01); *B65H 9/101* (2013.01); *B65H 9/163* (2013.01)

(58) Field of Classification Search

CPC ... B41J 11/00; B41J 29/00; B41J 13/24; B41J 17/32; B41J 13/10; B65H 9/08; B65H 9/101; B65H 9/163

See application file for complete search history.

(56) References Cited

U.S. PATENT DOCUMENTS

| | | | | |
|---|---|---|---|---|
| 1,929,816 | A * | 10/1933 | Hanson | G03B 27/28 355/125 |
| 2009/0179930 | A1* | 7/2009 | Morgan | B41J 2/16505 347/9 |
| 2012/0105875 | A1* | 5/2012 | Chinnici | G06T 11/60 358/1.9 |

* cited by examiner

*Primary Examiner* — Sharon A Polk

(74) *Attorney, Agent, or Firm* — The Law Office of H. Dale Langley, Jr. P.C.

(57) ABSTRACT

A system includes a carrier frame having a void, a rigid substrate sized slightly smaller than the void, the rigid substrate is connected to the carrier frame within the void, and a tape connected to edges of the rigid substrate and the carrier frame along the edges of the rigid substrate. The system is for printing with a standard printer to provide a full bleed print on the rigid substrate.

20 Claims, 4 Drawing Sheets

300

108

102

104

FULL BLEED PRINTING OF RIGID SUBSTRATE

FIELD OF INVENTION

The invention is generally related to inkjet printing and more particularly relates to systems and methods for full bleed printing of rigid substrates.

BACKGROUND

Conventionally, inkjet printers print within boundaries of a given substrate. The boundaries of print are typically spaced some distance from edges of the substrate. Therefore, the printed area on the substrate is smaller in area than the aggregate surface area of the substrate. The substrate must, therefore, be cut along edges after printing to provide a full bleed printing appearance.

Cutting the substrate to provide a full bleed printing appearance consumes time and effort. This is particularly problematic with rigid substrates. The substrates must be cut by powered devices, such as electric saws, after printing. Cutting rigid substrates can be inaccurate, require precision measurement, and blemish or scratch the printed surface of the substrate. Morevoer, cutting rigid substrates involves extra steps after printing to provide a full bleed appearance of a print.

It would, therefore, be a significant improvement in that art and technology to provide full bleed printing of rigid substrates, using standard inkjet and other standard printers.

SUMMARY

An embodiment of the invention is a system including a carrier frame having a void, a rigid substrate of size of the void, the rigid substrate is connected to the void of the carrier frame, and a tape connected to edges of the rigid substrate and the carrier frame along the edges of the rigid substrate.

Another embodiment of the invention a method that includes providing a carrier frame, connecting a rigid substrate to the carrier frame, taping a backside of the rigid substrate to the carrier frame, and printing on a front side of the rigid substrate opposing the backside of the taping.

Yet another embodiment of the invention includes a printed rigid substrate having print in accordance with method.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
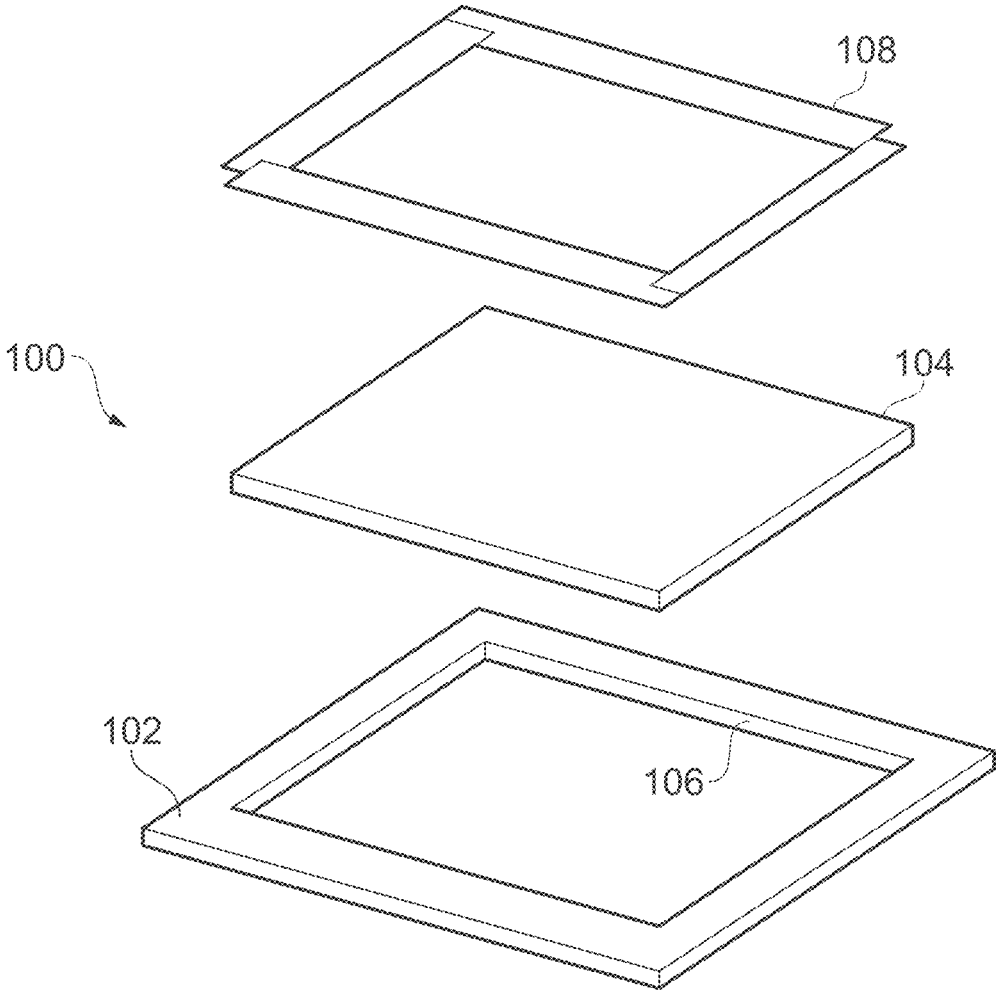
FIG. 1 illustrates an exploded view of a system of a carrier frame, a rigid substrate, and a tape connected to edges of the rigid substrate and the carrier frame, according to certain embodiments.
Figure 2:
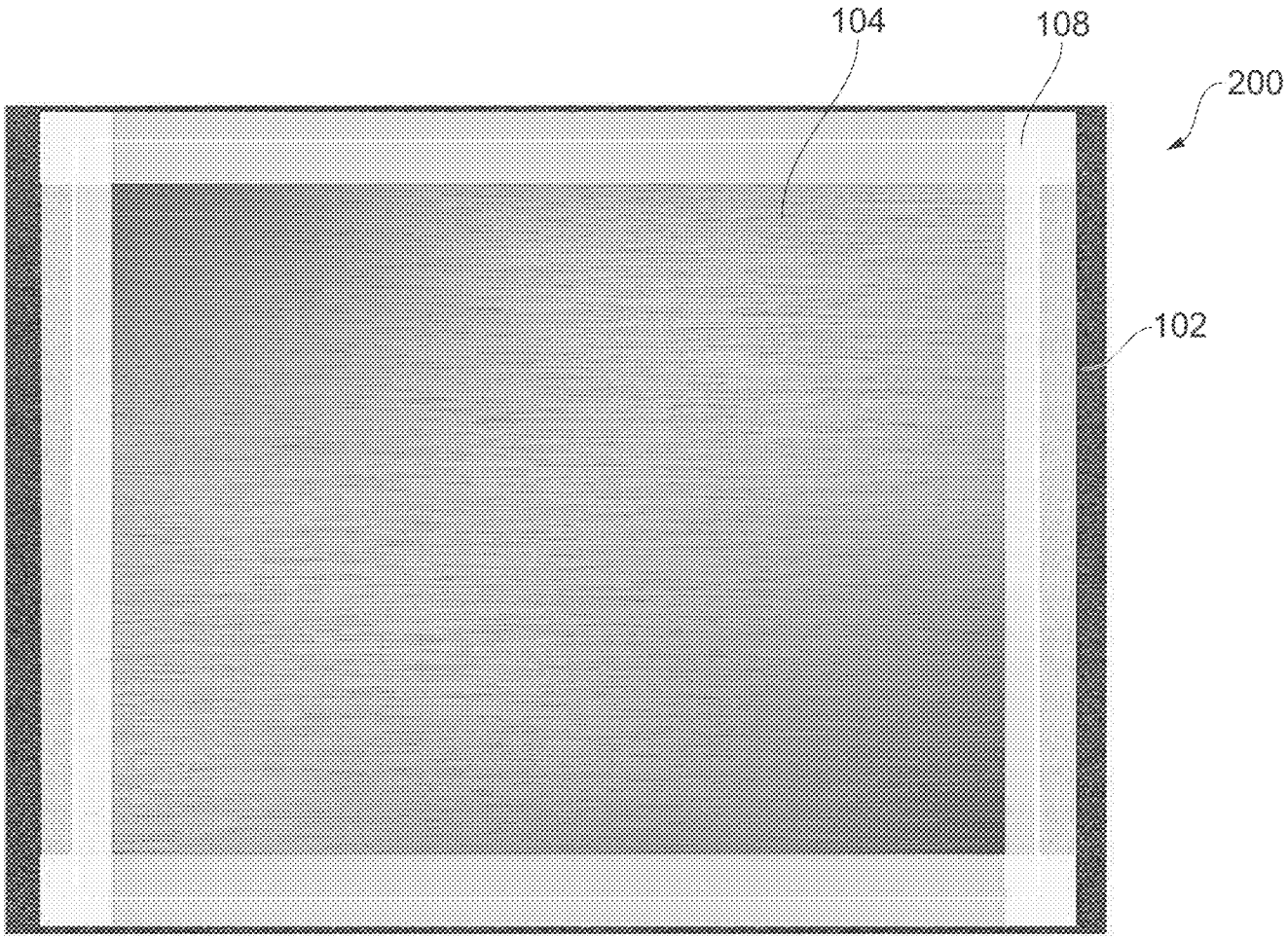
FIG. 2 illustrates a backside view of an assembly of the system of the carrier frame, the rigid substrate and the tape, according to certain embodiments.

Referring to FIGS. 1 and 2, a system 100 includes a carrier frame 102. The carrier frame 102 is sized to extend beyond the edges of a rigid substrate 104 for printing. The carrier frame 102 includes an internal void 106 of the size of the rigid substrate 104, such that the rigid substrate 104 fits squarely in the carrier frame 102. Thickness of the carrier frame 102 is about the same or thicker than the rigid substrate 104.

The rigid substrate 104 framed by the carrier frame 102 is retained to the carrier frame 102 by a tape 108 on the backside of the rigid substrate 104 and the carrier frame 102. For example, four strips of the tape 108 extend along respective edges of the rigid substrate 104.

The system 100 is fed through a printer, such as an inkjet printer capable of printing to rigid surface, with the tape 108 on the underside. The printer prints beyond the edges of the rigid substrate 104 and onto portions of the carrier frame 102. When printing is complete, the tape 108 is removed and the rigid substrate 104 is removed from the void 106 of the carrier frame 102. A full bleed print on the rigid substrate 104 is obtained.

The carrier frame 102 may be formed of any suitable fairly rigid material, for non-exclusive example, corrugated board, wood, cardboard, metal, thick paper or other. zo Thickness of the carrier frame 102 may be about the same thickness as the rigid substrate 104 or thicker. Sizing of the carrier frame 102 is such that about 1" to about 2" of spacing of the carrier frame 102 surrounds the rigid substrate 104 during use. The rigid substrate 104 can be any desired media material for printing, for non-exclusive example, metal, wood, veneer, laminate, polymer, plastic, paper, fiber, foam board, or other sheet. The tape 108 may be artist's tape or other tape or fixing medium.

Referring to FIG. 2, a system 200 includes the rigid substrate 104 connected to the void 106 of the carrier frame 102 by the tape 108. The opposing side 202 of the rigid substrate 104, opposite the tape, is ready for printing. In the printing, the side 202 of the rigid substrate 104 is fed, together with the carrier frame 102 framing the rigid substrate 104 to the printer. Printing is performed on the side 202. The printing extends to the edges of the rigid substrate 104 and may, in certain but not necessarily all instances, extend partially onto the carrier frame 102 near the edges of the rigid substrate 104. The tape 108 retains the rigid substrate 104 to the carrier frame 102 during printing.

Figure 3:
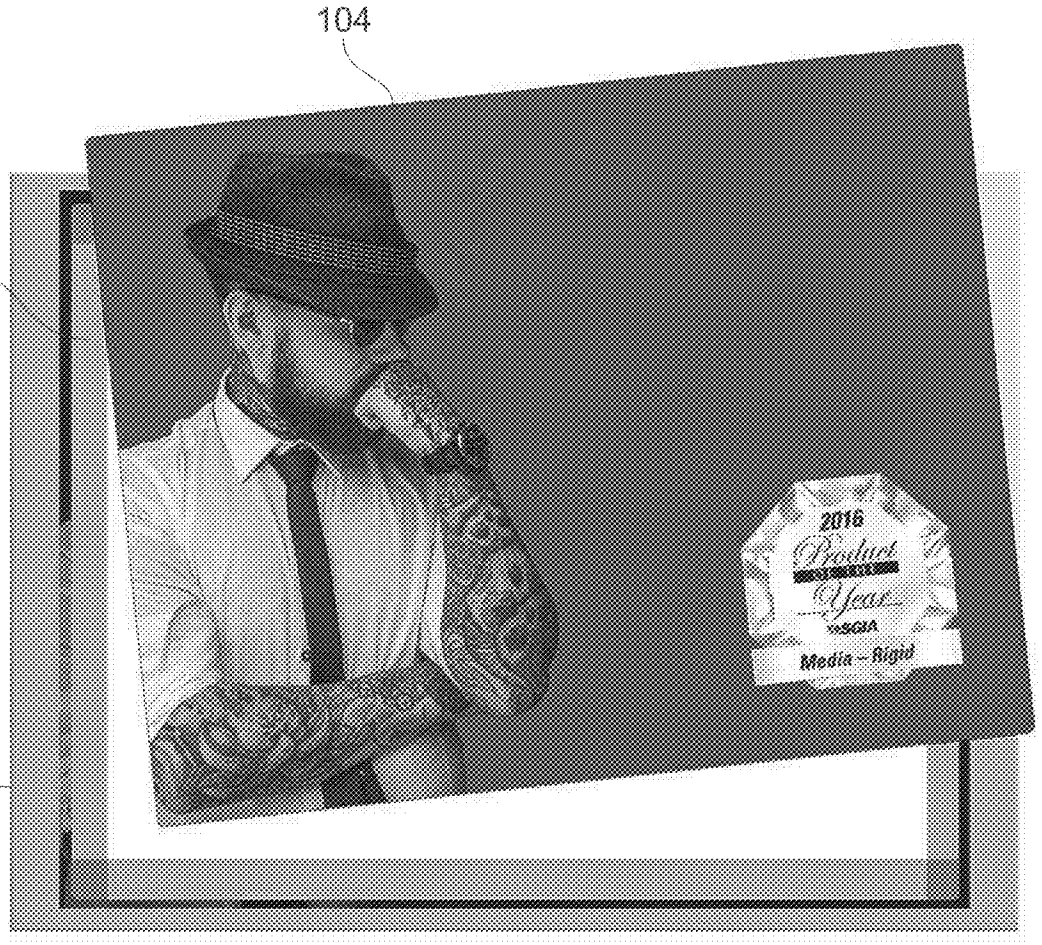
FIG. 3 illustrates a front print-side view of a printed rigid substrate on removal from a carrier frame and tape, according to certain embodiments.

Referring to FIG. 3, a system 300 includes the rigid substrate 104 removed from the void 106 of the carrier frame 102 and the tape 108. In certain non-exclusive embodiments, the carrier frame 102 may be re-used for another printing. The tape 108 is removed from the carrier frame 102, another rigid substrate is placed in the void 106 of the carrier frame 102, tape 108 is applied along the edges of the other rigid substrate and portions of the carrier frame 102, and the assembly is flipped for printing on the opposing side of the other rigid substrate.

Figure 4:
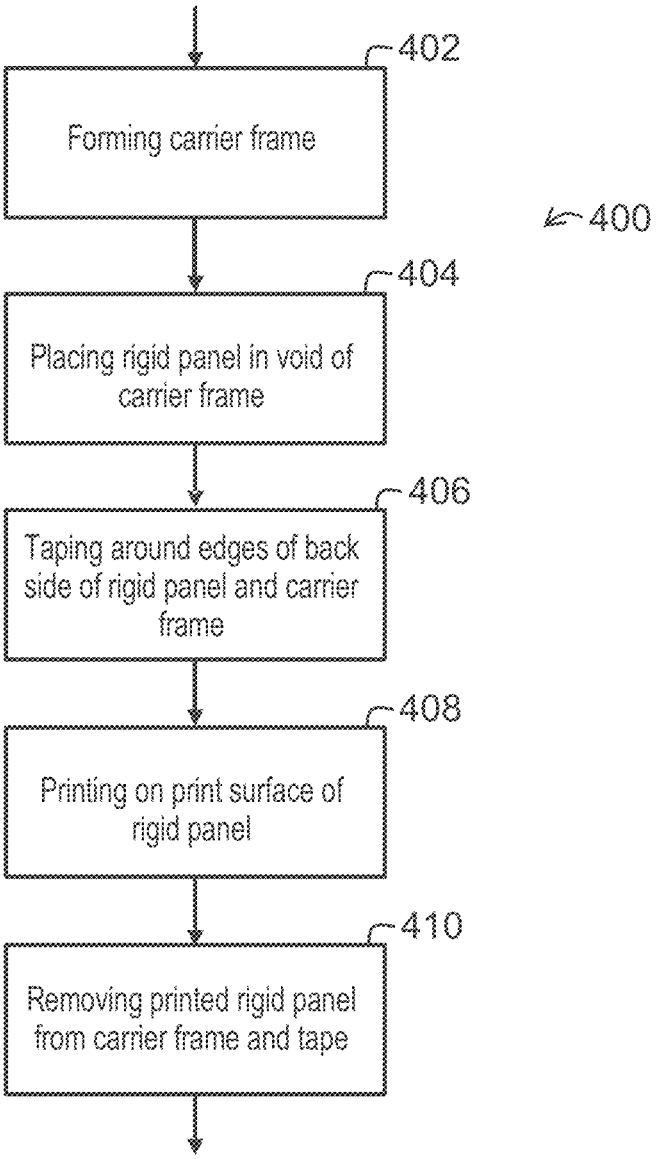
FIG. 4 illustrates a method of printing a full bleed print onto a rigid substrate by employing a carrier frame and tape, according to certain embodiments.

Referring to FIG. 4, a method includes forming 402 a carrier frame. The carrier frame is formed, as non-exclusive example, by trimming a stock to the desired extents of the frame and cutting a void in the trimmed stock of the desired size of a rigid panel. The stock is chosen to have a thickness of about that of the rigid panel or greater. The rigid panel is then placed 404 within the void of the frame. Taping 406 with a tape is performed around the edges of the rigid panel and onto the carrier frame.

The carrier frame, rigid panel and tape combination is fed to a printer, and the printer prints 408 onto a print side of the rigid frame opposing the tape. After printing, the rigid panel, which has been printed, is removed 410 from the carrier frame and the tape. The printed rigid panel may be framed, displayed without framing, or as otherwise desired.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system, comprising:

a carrier frame of a first thickness having a void;

a tape;

a rigid substrate of a second thickness connected to the carrier frame within the void by the tape connected to edges of the rigid substrate and the carrier frame along the edges of the rigid substrate, the second thickness is about equal to or less than the first thickness; and an ink on the rigid substrate opposing the tape, printed for full bleed on the rigid substrate in respect of the carrier frame;

wherein the carrier frame receives ink along the edges of the void to allow the ink on the rigid substrate to be full bleed on the rigid substrate.

2. The system of claim 1, further comprising:

a printer for printing the ink on the rigid substrate opposing the tape.

3. The system of claim 2, wherein the print extends to the edges of the rigid substrate and onto the edges of the carrier frame surrounding the void.

4. The system of claim 2, wherein the rigid substrate is printed on by an inkjet printer.

5. The system of claim 4, wherein the print on the rigid substrate is full bleed on the rigid substrate and onto the edges of the carrier frame surrounding the void.

6. The system of claim 1, wherein the void of the carrier frame is sized to fit the rigid substrate within the void.

7. The system of claim 1, wherein the carrier frame has a thickness between about thickness of the rigid substrate and thickness greater than thickness of the rigid substrate.

8. A method, comprising:

providing a carrier frame having a void, the carrier frame is of a first thickness;

placing a rigid substrate in the void of the carrier frame, the void is sized to accommodate the rigid substrate, the rigid substrate has a second thickness equal to or less than the first thickness;

taping along a backside of the rigid substrate and the carrier frame, to retain the rigid substrate in the void of the carrier frame;

providing a printer;

feeding to the printer the carrier frame and the rigid substrate taped in the void;

printing on a front side of the rigid substrate opposing the backside of the taping, printing on the rigid substrate covers the entire surface of the rigid substrate and bleeds onto adjacent edges of the carrier frame around the void; and removing the carrier frame and the rigid substrate from the printer.

9. The method of claim 8, further comprising:

removing the rigid substrate from the carrier frame.

10. A printed rigid substrate manufactured in accordance with the method of claim 9.

11. The method of claim 8, wherein printing is full bleed on the rigid substrate.

12. A printed rigid substrate manufactured in accordance with the method of claim 11.

13. The method of claim 8, wherein providing the carrier frame includes sizing the carrier frame larger than the rigid substrate and sufficient for feed into a printer for the printing and forming a void in the carrier frame of size substantially of the rigid substrate.

14. The method of claim 13, wherein placing the rigid substrate includes inserting the rigid substrate in the void of the carrier frame.

15. The method of claim 13, wherein providing the carrier frame includes selecting a material that has thickness between about thickness of the rigid substrate and thickness greater than thickness of the rigid substrate.

16. A printed rigid substrate manufactured in accordance with the method of claim 13.

17. The method of claim 8, wherein taping includes attaching a tape along the edges of the rigid substrate and adjacent portions of the carrier frame to the rigid substrate around the void.

18. The system of claim 8, wherein printing is full bleed on and covers the rigid substrate and adjacent portions of the carrier frame.

19. The method of claim 8, wherein printing is performed by an inkjet printer.

20. A printed rigid substrate manufactured in accordance with the method of claim 8.

* * * * *